US009004176B2

(12) United States Patent
Crossley et al.

(10) Patent No.: US 9,004,176 B2
(45) Date of Patent: Apr. 14, 2015

(54) MARINE WELL CONTAINMENT SYSTEM AND METHOD

(75) Inventors: Calvin W. Crossley, Houston, TX (US); Jeffrey W. Jones, Houston, TX (US); Allen P. Allegra, Houston, TX (US); Jonathan Bowman, Houston, TX (US); Lloyd Brown, Houston, TX (US); John Dagleish, Houston, TX (US); Brian J. Fielding, Houston, TX (US); Mitch Guinn, Houston, TX (US); Joe Q. Jin, Houston, TX (US); Wan Cai Kan, Houston, TX (US); Roald T. Lokken, Houston, TX (US); Mario R. Lugo, Houston, TX (US); Peter G. Noble, Houston, TX (US); Matthew J. Obernuefemann, Houston, TX (US); Murray Smith, Houston, TX (US); Paul M. Sommerfield, Houston, TX (US); Charlie Tyrell, Houston, TX (US); Richard Weser, Houston, TX (US); Stephen Wetch, Houston, TX (US)

(73) Assignee: Marine Well Containment Company, Houston, TX (US)

( * ) Notice: Subject to any disclaimer, the term of this patent is extended or adjusted under 35 U.S.C. 154(b) by 296 days.

(21) Appl. No.: 13/188,330

(22) Filed: Jul. 21, 2011

(65) Prior Publication Data

US 2012/0018165 A1 Jan. 26, 2012

Related U.S. Application Data

(60) Provisional application No. 61/366,458, filed on Jul. 21, 2010.

(51) Int. Cl.

| | |
|---|---|
| ***E21B 43/01*** | (2006.01) |
| ***E21B 23/00*** | (2006.01) |
| ***E21B 33/037*** | (2006.01) |

(52) U.S. Cl.
CPC ..... *E21B 43/0122* (2013.01); *E21B 33/037* (2013.01)

(58) Field of Classification Search
USPC ..... 166/75.13, 339, 345, 352, 356, 363, 166/364, 367–369.379, 380, 79.1, 81.1, 166/97.1; 405/224.2, 64; 138/155
See application file for complete search history.

(56) References Cited

U.S. PATENT DOCUMENTS

| | | | |
|---|---|---|---|
| 1,830,061 | A | 11/1931 | Howe |
| 1,859,606 | A | 5/1932 | Sievern et al. |

(Continued)

FOREIGN PATENT DOCUMENTS

| | | | |
|---|---|---|---|
| EP | 2 407 631 | A1 | 1/2012 |
| GB | 2481125 | A | 12/2011 |

OTHER PUBLICATIONS

Lugo, Ixtoc No. 1, Blowout and Control Operation, SPE 9697, Deep Drilling & Production Symposium of the Society of Petroleum Engineers of AIME, Apr. 5-7, 1981, held in Amarillo, Texas.

(Continued)

*Primary Examiner* — James G Sayre
(74) *Attorney, Agent, or Firm* — Norton Rose Fulbright US LLP

(57) ABSTRACT

A system and method for rapidly responding to and regaining control of uncontrolled flow from offshore hydrocarbon wells, comprising a subsea containment assembly, optionally including a capture caisson assembly installed around the assembly, riser systems for production of hydrocarbons to capture vessels on the surface of the sea, and modularized subsystems facilitating communication between and fluid flow from the subsea containment assembly through the riser to the capture vessel.

33 Claims, 3 Drawing Sheets

(56) References Cited

U.S. PATENT DOCUMENTS

| | | | | | |
|---|---|---|---|---|---|
| 3,409,084 | A | * | 11/1968 | Lawson, Jr. et al. | 166/86.1 |
| 3,745,773 | A | | 7/1973 | Cunningham | |
| 4,283,159 | A | | 8/1981 | Johnson et al. | |
| 4,290,714 | A | | 9/1981 | Strange | |
| 4,323,118 | A | * | 4/1982 | Bergmann | 166/96.1 |
| 4,324,505 | A | | 4/1982 | Hammett | |
| 4,375,835 | A | | 3/1983 | Archer | |
| 4,393,906 | A | | 7/1983 | Gill | |
| 4,405,258 | A | | 9/1983 | O'Rourke et al. | |
| 4,440,523 | A | | 4/1984 | Milgram et al. | |
| 4,449,850 | A | | 5/1984 | Cessou et al. | |
| 4,456,071 | A | | 6/1984 | Milgram | |
| 4,660,606 | A | | 4/1987 | Cheung | |
| 5,213,444 | A | | 5/1993 | Henning | |
| 5,937,947 | A | * | 8/1999 | Holtby | 166/379 |
| 7,621,059 | B2 | | 11/2009 | McCoy, Jr. et al. | |
| 7,987,903 | B1 | * | 8/2011 | Prado Garcia | 166/75.13 |
| 8,025,103 | B1 | * | 9/2011 | Wolinsky | 166/364 |
| 8,322,437 | B2 | * | 12/2012 | Brey | 166/363 |
| 2005/0061515 | A1 | * | 3/2005 | Hopper | 166/367 |
| 2007/0044972 | A1 | * | 3/2007 | Roveri et al. | 166/367 |
| 2008/0302536 | A1 | * | 12/2008 | Kotrla et al. | 166/341 |
| 2009/0050329 | A1 | * | 2/2009 | Johnson et al. | 166/339 |
| 2011/0286797 | A1 | | 11/2011 | Boyd | |
| 2011/0315393 | A1 | | 12/2011 | Wolinsky | |
| 2011/0315394 | A1 | | 12/2011 | Wolinsky | |
| 2011/0315395 | A1 | | 12/2011 | Wolinsky | |
| 2011/0315396 | A1 | | 12/2011 | Wolinsky | |
| 2011/0318108 | A1 | | 12/2011 | Wolinsky | |
| 2011/0318114 | A1 | | 12/2011 | Wolinsky | |
| 2012/0006559 | A1 | | 1/2012 | Brite | |
| 2012/0055573 | A1 | | 3/2012 | Adams | |

OTHER PUBLICATIONS

Aalbers et al., DP assisted and Passive Mooring for FPSO's, 27$^{th}$ Annual Offshore Technology Conference, May 1-4, 1995, held in Houston, Texas.

Tangvald et al., Operating Experience with Navion Munin FPSO at the Lufeng Field, 2000 Offshore Technology Conference, May 1-4, 2000, held in Houston, Texas.

BP America Inc., Notebook of Materials of Publicly Disclosed from May to Sep. 2010 by BP; formerly available at http://bp.com/sectiongnericarticle.do?categoryId=9036897&contentID=7067981.

International Search Report dated Dec. 22, 2011 during prosecution of International Application No. PCT/US2011/044873.

Ronalds, B.F., et al. "FPSO Trends", Society of Petroleum Engineers, SPE 56708, prepared for presentation at the 1999 SPE Annual Technical Conference and Exhibition held in Houston, Texas, Oct. 3-6, 1999.

Wallace, Kimberly M., et al., "Performance Record for FPSOs and Shuttle Tankers", OTC 11002, prepared for presentation at the 1999 Offshore Technology Conference held in Houston, Texas, May 3-6, 1999.

Subsea IP Holdings LLC, "Subsea Applications from Subsea Website", 2011.

Bluewater, Munin FPSO, Bluewater Website, http://www.bluewater-offshore.com/operations.asp?refID=42&ID=42&contentID=26&fleet, 2010.

The Economist, "The Price of Staying in the Game, Fixing Oil Wells, Oil Companies are Now Developing a System that Could Cap Deepwater Wells in the Gulf of Mexico in a Hurry", Aug. 12, 2010, print edition, http://www.economist.com/node/16789834.

Early Blogs Discussing Containment Pile Well Control, 2010.

* cited by examiner

MARINE WELL CONTAINMENT SYSTEM AND METHOD

CROSS-REFERENCE TO RELATED APPLICATIONS

This application claims benefit of U.S. Provisional Application No. 61/366,458 filed on Jul. 21, 2010, which is incorporated herein by reference in its entirety.

TECHNICAL FIELD

The disclosure herein relates generally to a rapid response system to capture and contain oil from uncontrolled releases of hydrocarbons.

BACKGROUND OF THE INVENTION

This section is intended to introduce various aspects of the art, which may be associated with exemplary embodiments of the present disclosure. This discussion is intended to provide a framework to facilitate a better understanding of particular aspects of the disclosure. Accordingly, it should be understood that this section should be read in this light, and not as admissions of prior art.

Since the oil and gas industry first began drilling offshore wells in the middle half of the twentieth century, tens of thousands of wells have been drilled in water depths ranging from a few feet to more than ten thousand feet. In recent years, as the industry has moved farther offshore into deepwater, more than 14,000 wells have been drilled around the world.

One of the challenges of deepwater drilling and production is to ensure that the industry has the capability to maintain the strong record of high standards in the area of health, safety and environmental protection that it has attained in shallow water and onshore. The extensive experience of industry is that when the focus remains on safe operations and risk management, unfortunate offshore incidents should not occur, when they do, those incidents represented a dramatic departure from industry norms in deepwater drilling and both underscore and reinforce industry's long-held views on the importance of safety in all areas of operation.

Certain activities applicable to all water depths can be undertaken to improve well control, and to ensure plans are in place for well interventions and spill response, should such be required. For example, additional procedures involving rig inspections can be undertaken, and requirements implemented on blowout preventer certification and well design. The industry can also form, and has done so, multi-disciplinary task forces to further develop improved prevention, containment and recovery plans.

Nevertheless, deepwater activities remain among the most complex and challenging that industry faces. For example, in deepwater, operations which may be routinely carried out by divers in shallow water are not accessible to divers. Remotely operated vehicles can be used in all water depths, as a general rule, but the added complexity of operating in deepwater increases the challenge of successfully carrying out operations which in shallow water are routine. These challenges are amplified in situations in which deepwater well equipment requires repairs or replacements, and in the rare event that a well blowout requires rapid response.

It remains desirable to provide improvements in marine well containment systems and methods in efficiency, flexibility, and capability for deployment.

BRIEF SUMMARY OF THE INVENTION

The present disclosure relates to a containment system for offshore well control which is flexible, adaptable and for deployment within days and fully operational within weeks of an incident requiring well control. The system, referred to herein as the Marine Well Containment System, or "MWCS," can be deployed after a well control incident to capture and fully contain flowing oil and natural gas with no significant flow to the sea after deployment. Embodiments of the system can be engineered to provide a capacity up to 100,000 barrels per day or more.

The system seals the well via either a well connected system or a seabed connected system. The system provides at least the following advantages:

minimizes back pressure on a flowing well that may have suspected damage to either the casing string(s), wellhead, or the BOP thereby ensuring that no further damage is sustained to the well until such time as a relief well is completed and effectively 'kills' the well.

minimizes seawater ingress which reduces the chances of hydrate formation which would block flowlines.

enhances response capabilities for maximum protection of the environment as well as the safety and health of both the public and personnel.

utilizes the industry's vast knowledge of offshore equipment and operations.

allows for the incorporation of new technologies that may be developed in the future.

A key advantage of embodiments of the present disclosure as compared to current response equipment is that it can be pre-engineered, constructed, tested and ready for rapid deployment. The embodiments disclosed herein are more flexible and adaptable and as a result provide the ability to respond to a wider range of potential response situations. Also, the system is better equipped to handle weather conditions and other challenges that arise in far offshore, deepwater environments, and the system can be maintained in a state of continuous operational readiness. From a state of continuous operational readiness, mobilization can be carried out rapidly.

In general, the marine well containment system for producing fluids from a marine oil and gas well comprises a subsea containment assembly. In some embodiments, the marine well containment system further includes a blowout preventer ("BOP"), a riser assembly involving a vertical pipe riser and a flexible riser connected to the subsea containment assembly via flexible jumpers or umbilicals, or both, and a capture vessel connected to the riser assembly, wherein the fluids produced from the blown out well are captured by the subsea containment assembly and piped through the riser assembly to the capture vessel. In an additional and alternate embodiment, the marine well containment system for producing fluids from a marine oil and gas well may be used where damage is believed to have occurred to the blowout preventer or casing of the well. In this and other embodiments, the marine well containment system may include a capture caisson installed around the blowout preventer and into the seafloor.

The above described marine well containment systems involve a single riser assembly, and although the discussion which follows generally refers to such systems, such discussion is by no means limiting on the disclosure herein. As will be understood to those skilled in the art, and in part as is exemplified in the Figures, embodiments with multiple riser assemblies are fully within the scope of the present disclosure. Other embodiments of the present disclosure will be apparent to those skilled in the art.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

While the present disclosure is susceptible to various modifications and alternative forms, specific exemplary implementations thereof have been shown in the drawings and are herein described in detail. It should be understood that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present disclosure. Moreover, certain dimensions may be exaggerated to help visually convey such principles. Further where considered appropriate, reference numerals may be repeated among the drawings to indicate corresponding or analogous elements. The present disclosure and its advantages will therefore be better understood by referring to the attached drawings in which:

Figure 1:
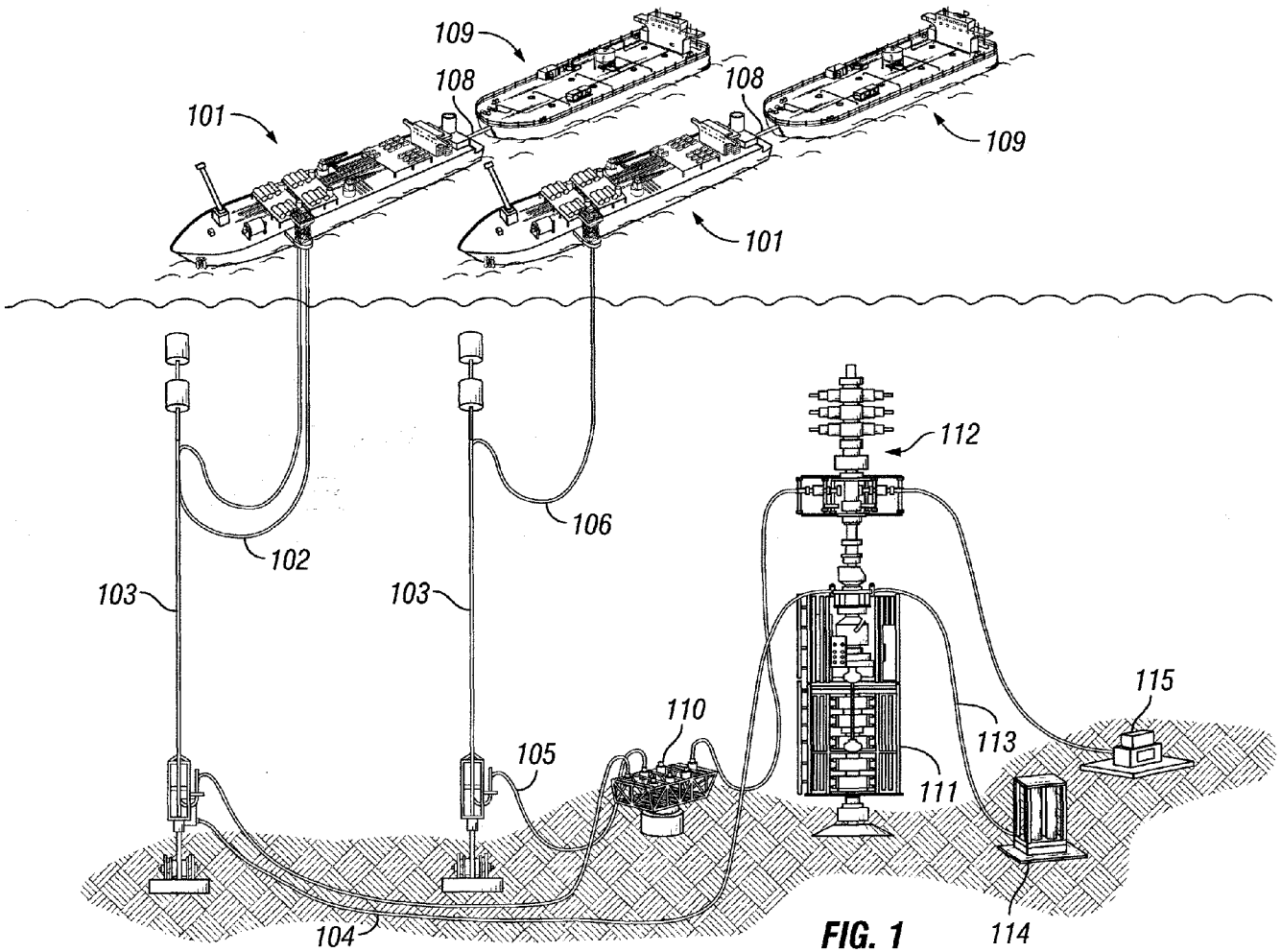
FIG. 1 is a schematic of the overall system components, including the subsea and the surface subsystems.

To the extent that the following detailed description is specific to a particular embodiment, however, this is intended to be illustrative only, and is not to be construed as limiting the scope of the disclosure.

DETAILED DESCRIPTION OF THE INVENTION

Reference will now be made to exemplary embodiments and implementations. Alterations and further modifications of the inventive features described herein and additional applications of the principles of the disclosure as described herein, such as would occur to one skilled in the relevant art having possession of this disclosure, are to be considered within the scope of the disclosure. Further, before particular embodiments of the present disclosure are disclosed and described, it is to be understood that this disclosure is not limited to the particular process and materials disclosed herein as such may vary to some degree. Moreover, in the event that a particular aspect or feature is described in connection with a particular embodiment, such aspects and features may be found and/or implemented with other embodiments of the present disclosure where appropriate. Specific language may be used herein to describe the exemplary embodiments and implementations. It will nevertheless be understood that such descriptions, which may be specific to one or more embodiments or implementations, are intended to be illustrative only and for the purpose of describing one or more exemplary embodiments. Accordingly, no limitation of the scope of the disclosure is thereby intended, as the scope of the present disclosure will be defined only by the appended claims and equivalents thereof.

In the interest of clarity, not all features of an actual implementation are described in this disclosure. For example, some well-known features, principles, or concepts, are not described in detail to avoid obscuring the disclosure. It will be appreciated that in the development of any actual embodiment or implementation, numerous implementation specific decisions may be made to achieve the developers' specific goals, such as compliance with system-related and business-related constraints, which will vary from one implementation to another. For example, the specific details of an appropriate computing system for implementing methods of the present disclosure may vary from one implementation to another. Moreover, it will be appreciated that such a development effort might be complex and time-consuming, but would nevertheless be a routine undertaking for those of ordinary skill in the art having the benefit of the present disclosure.

Conceptually, but without limitation, embodiments of the present disclosure include subsea containment equipment connected by risers to vessels that can safely capture, store and offload the oil. The specially designed subsea containment equipment is connected by manifolds, jumpers and risers to the capture vessels that will store and offload the oil.

Individual subsystems of the system of the present disclosure are more fully described in the following paragraphs, and are discussed with reference to the Figures attached herein.

Subsea Components

The subsea components of the MWCS include subsystems which are well-known in industry, and subsystems designed specifically for use in the MWCS.

The subsea containment assembly (112) is connected to the damaged well. Once connected, the subsea containment assembly (112) prevents oil from escaping into the water. The containment assembly (112) is equipped with a suite of adapters and connectors to interact with various interface points such as the wellhead, blowout preventer stack, lower marine riser package casing strings, and capture caisson. The subsea containment assembly (112) allows an operator to establish sealed connections with subsea drilling equipment. The sealed connections can then be used to re-enter the wellbore through the previously installed casing. The subsea containment assembly (112) includes multiple production and venting outlets, which can be used for producing or venting. The subsea containment assembly (112) also includes numerous ports through which inhibitors for hydrates, wax, corrosion, and scale can be injected. It also provides a means to monitor subsea pressures and temperatures through gauges installed therein. It also provides a means to facilitate a possible well shut-in.

All of the above characteristics of the subsea containment assembly combine to provide improved well backpressure control as compared to that available in prior systems and methods. The system is adaptable to any well design and equipment used by the various operators in the Gulf of Mexico and other deepwater areas around the world.

Figure 3:
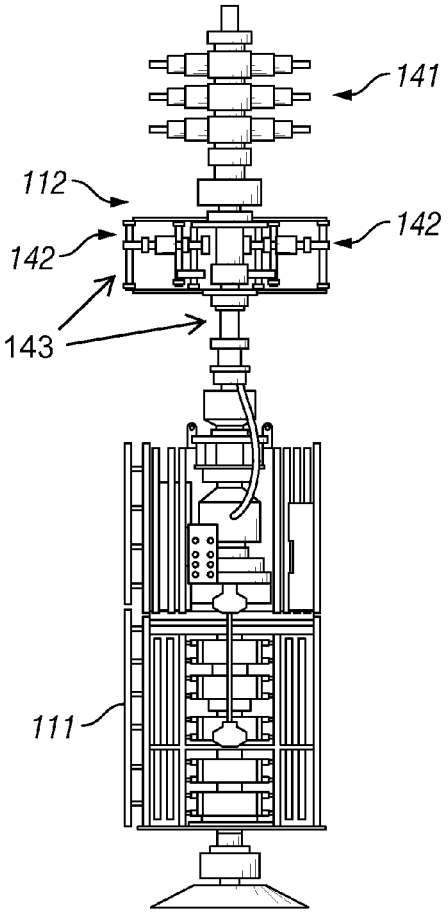
FIG. 3 is a schematic of the subsea containment assembly of the subsea subsystem installed on a blowout preventer.
Figure 4:
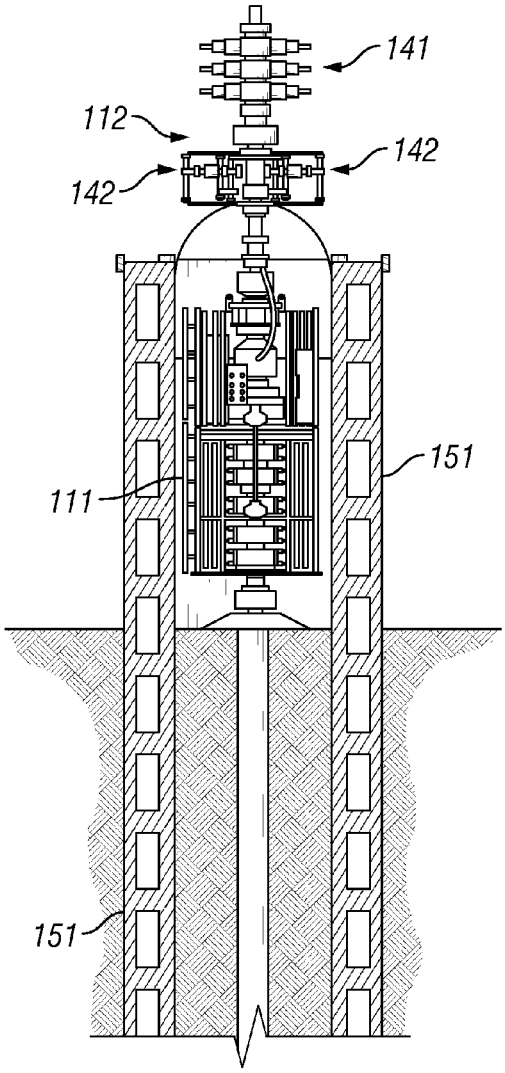
FIG. 4 is a schematic of a seabed connected embodiment of the present disclosure, including a subsea containment assembly installed on a blowout preventer, and a capture caisson installed in the seafloor around the circumference of the blowout preventer.

FIGS. 1, 3, and 4, show the containment assembly (112) installed on the BOP (111). The containment assembly (112) is show with three rams (141), but the present disclosure is not limited to that number. All connections are standard flange designs widely used in industry, and may take advantage of multiple adapters to ensure connectability with systems that are used or may be used in the future. This is consistent with the standard, modularized, kit-deployment philosophy of the MWCS. Preferentially, but not to be limiting, the subsea containment assembly (112) may include a connection above the rams for connecting to a drilling riser or risers (not shown). Every ram has choke and kill ability which may be used facilitate the various operations that are required.

Also, the present disclosure contemplates various arrangements with respect to the BOP and the components of the containment assembly (112), in particular, the relationship with respect to the collection and venting outlets, the BOP and the ram portion of the containment assembly. For example, as shown in FIG. 3, the ram portion (141) of the containment assembly (112) is separated from the BOP (111) by the multiple collection and venting outlets (142) of the subsea containment assembly. In an alternate embodiment, the ram portion (141) of the containment assembly (112) is not separated from the BOP (111) by the multiple collection and venting outlets (142) of the subsea containment assembly. In this alternate embodiment, the multiple collection and venting outlets (142) of the subsea containment assembly (112) are separated from the BOP (111) by the ram portion (141) of the subsea containment assembly. In additional embodiments, the subsea containment assembly comprises more than one set of multiple collection and venting outlets (142) separated by at least one ram.

FIG. 1 depicts the situation in which there is no significant damage to the BOP. When the BOP is not damaged the containment assembly (112) can be attached to the BOP using normal connections. For example, the containment assembly (112) is latched to the BOP in the same manner as the riser. However, situations may arise in which leaks are outside the casing, the BOP connector is damaged, or the BOP stack is leaking. In these situations, a capture caisson subsea containment assembly (151) is implemented, as depicted in FIG. 4. The capture caisson (151) encloses the BOP (111). The containment assembly (112) can be connected to the top of the capture caisson (151) and thus allow pumping and lifting of fluids, if desired. FIG. 4 depicts containment assembly (112) connected to the BOP.

The subsea containment assembly (112) may be the same both for the caissonless embodiment of FIG. 1, and the caisson embodiment of FIG. 4. In alternate embodiments connections to a riser adapter may occur, or to a casing string, depending on the situation being addressed. This alternate embodiment in consistent with the kit-based philosophy of the MWCS. Note that in each case the subsea containment assembly (112) offers a first response mechanism which may allow production to proceed through a riser.

As indicated, capture caisson (151) may be used to enclose a damaged connector or leak outside the well casing. These capture caissons (151) employ suction pile technology to create a seal with the seabed that prevents seawater from entering the assemblies and prevents hydrate formation. The capture caisson (151) provides for a unique application of suction pile technology to provide a circular ring assembly that penetrates into the seabed to form a secure foundation and seal around the damaged well. In some examples, the containment assembly (112) is connected to the BOP in place, over the wellhead if the BOP has been removed, or directly to the capture caisson.

However, the capture caissons (151) of the present disclosure incorporate differences from most suction piles. The donut shaped system (151) of FIG. 4 is an annular caisson in which the drawdown occurs by pulling down between the inner and outer walls, to thus obtain the pile function, with the fluid path in the center of the caisson. The cap shown in FIG. 4 is installed thereafter, or the cap is installed first and used as a guide to ensure that the caisson is installed in the desired vertical orientation. Note that the cap may not have a top seal in some applications, in particular where a space exists between BOP and cap. In some examples, the capture caisson is installed or used without any mechanical connection at the top of the BOP. On other examples, the capture caisson is installed or used with a mechanical connection at the top of the BOP.

In some situations, more than one capture caisson is used. For example, it may be necessary to use a two capture caisson embodiment for a given incident. When considering a one or more capture caisson embodiment, the skilled artisan may use the same approach as he would when considering a one capture caisson embodiment. For example, if the BOP (111) remains in place, a capture caisson (151) is positioned over the BOP for installation. In an alternative embodiment where the BOP is no longer on the seafloor at the location of the well, a capture caisson (151) is installed directly over the well. In either case, the length of the capture caisson will be sized to accommodate the local soil conditions. This again facilitates the design of the MWCS as being modular and fit to purpose.

Embodiments of the capture caisson subsystem may involve attachments to the subsea containment assembly (112), the BOP (111), or to casing to ensure a strong foundation is established for stability of the caisson, which would otherwise be subject to potential uplift failure. As will be understood to those skilled in the art, mechanisms will be required to maintain the stability of the caisson and the well, maintain the effectiveness of the foundation, and adapt caisson transfer loads to the well casing. Embodiments of the capture caisson subsystem may also involve use of an artificial lift system to ensure back pressure is minimized, again to ensure no uplift but rather stability of the caisson. The artificial lift capability designed into the system further reduces the risk of back pressure from the hydrostatic head resulting from up to the design limit of 10,000 feet water column.

The multiple collection and venting outlets (142) of the subsea containment assembly also facilitate monitoring backpressure in the well, facilitate venting when necessary, and a return to collection thereafter. The caisson (151) can be designed to provide a complete capping of the flow, if desired, without a significant change in the other equipment of the MWCS. The monitoring and minimizing of back pressure on the flowing well is achieved through the large, multiple flexible flowlines (105), rigid risers (103) originating from a subsea manifold (110) connected to a subsea containment spool mounted on the subsea BOP, either directly to the well or directly to the casing strings.

An advantage of the subsea containment assembly, whether or not a capture caisson is required, is that it can be installed from any available vessel of opportunity, such as drilling rigs, work vessels, installation vessels, and the like. The subsea containment assembly (112) is therefore designed to be immediately available, and thus compact and lightweight. The containment assembly (112) may be installed through a moonpool of an offshore vessel. The caisson (151) may also be installed through a moonpool, though given its likely larger size larger deployment vessels may be required. However, caissons (151) may be constructed of several sizes, or modular, to ensure adaptability to the situation being addressed.

The subsea containment assembly (112) captures flow from the well and directs the flow to a riser assembly (103) through flexible pipe (105). Riser assemblies (103) may include a seabed foundation, vertical pipe, buoyancy tanks and a flexible pipe (106), or umbilical (102) configured to connect to the capture vessels (101). The vertical pipe portion of the riser will in most embodiments be a mechanically connected standard casing-string type self-standing riser, while the catenary portion nearer the surface, as depicted in FIG. 1, may be flexible pipe risers.

The riser assemblies depicted in FIG. 1, are designed to quickly disconnect from capture vessels (101) so that all subsea equipment stays in place in the event of a hurricane or other severe weather. This is accomplished by way of quick disconnects associated with umbilical (102) and flexible pipe (106). In addition to the emergency disconnect option for severe weather conditions, the subsea containment assembly (112) is capable of being used for a top kill option. In FIG. 4, the assembly has a triple ram (141) to facilitate shearing of what may be in the well and to facilitate a drive-off.

Certain of the other subsystems of the MWCS depicted for example in FIG. 1 are generally standard in industry, although embodiment-specific designs may be required or desired.

The accumulator unit (114) for example, whose purpose is to trickle charge, through an umbilical (113) stored hydraulic pressure, to subsea components is a generally standard operation in industry. However, in the MWCS it is envisioned that embodiments involve a self-contained module for reliability and convenience, in contrast to the standard approach of installing such units directly on the subsea equipment at issue. For example, the accumulator unit (114) may be installed on the seabed as shown in FIG. 1.

The subsea system will be supplied with the necessary hydraulic/electric controls to facilitate chemical injection of inhibitors (such as inhibitors for hydrate, wax, corrosion and scale) through an umbilical.

An additional system component (115) is available to inject dispersant into the subsea containment assembly (e.g. in the event of hurricane or other severe weather requiring disconnect from capture vessels). This dispersant fluid system is one of a number of potential embodiments. One approach might be to implement a system involving a standard kit of large bladders containing dispersant, each connected through a manifold into the system's electric motor which could operate for continuous flow of dispersant, as required during severe weather. Such a system would not be required otherwise, as dispersant could be provided through alternate means. Such large bladders could be recharged during normal weather operations, via an umbilical. An alternate way of recharging would be to install a completely new bladder bank, and retrieve the old bank for recharging and subsequent redeployment.

In some embodiments, a subsea manifold (110) is used to distribute produced fluids from the subsea containment assembly (112) to riser assemblies (103). In FIG. 1, the subsea manifold (110) is shown connected to multiple riser assemblies (103) and more than one capture vessel (101). The manifold (110) is configured for flexibility so that it may be used with a variety of types and locations of containment systems/vessels, and thus be simple and compact. The manifold (110) may also vent directly to the sea if necessary.

Although all flexible lines, pipes, and umbilicals (102, 104, 105, 113, 106, and 108) are generally standard, the flexible lines, pipes and umbilicals are designed for a quick disconnect capability to the maximum extent possible.

Installation of the subsea subsystems can be by any vessel of opportunity.

All subsea subsystems are designed to allow remotely operated vehicle intervention and other control-override options.

Surface Components

The system includes capture vessels (101) that process, store and offload the oil to shuttle tankers (109) which take the oil to shore for further processing. Capture vessels include, but are not limited to modified tankers, existing drill ships and extended well-test vessels.

Figure 2:
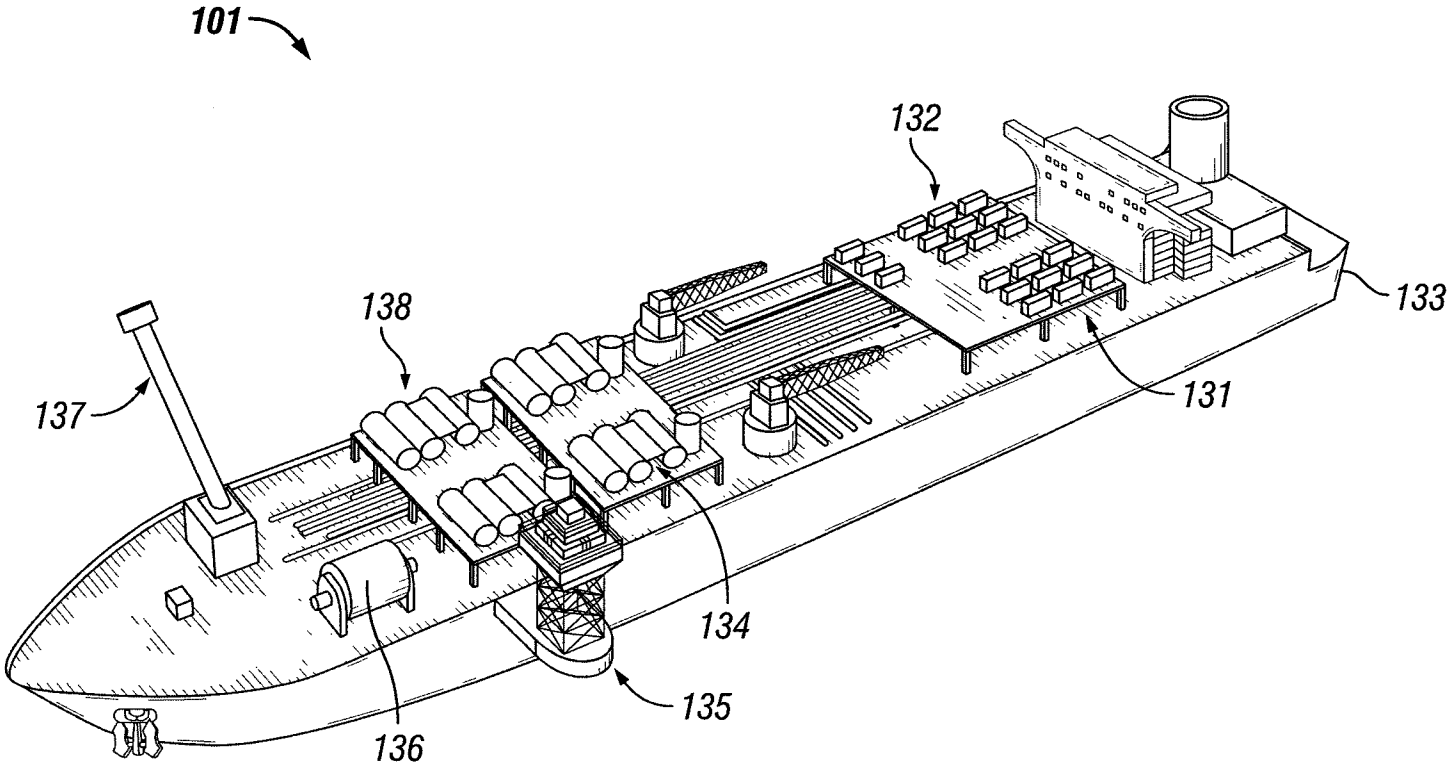
FIG. 2 is a schematic of a capture vessel and the modularized equipment of the MWCS.

In some examples, the system takes advantage of modular process equipment that is installed on the capture vessels, as depicted in FIG. 2. The modular process equipment connects to the riser assembly and may include, but are not limited to operations such as separating of oil from gas, flaring of gas (137) and safely storing and offloading oil to shuttle tankers. For example, FIG. 2 is a schematic of a capture vessel and the modularized equipment of the MWCS. The modular equipment found on the capture vessel (101) includes but is not limited to an offloading module (133), a utility module (131), living quarters (132), a turret module (135), a subsea support module (136), a 25KBD platformer (134) or (138) or any combination thereof.

During severe weather conditions, the capture vessels is able to disconnect and move away from the storm for the safety of the operating personnel. Once the severe weather conditions pass and the vessels return, they are capable of being operational within days.

The capture vessels are designed to be dynamically positioned for the purpose of the MWCS and thus are able to accept the required modular equipment shown in FIG. 2. This element of the MWCS allows for the MWCS to operate in weather conditions that are atypical. Note that the modular swivel system, shown as the Turret Module (135) in FIG. 2, is in particular an MWCS-specific concept designed specifically to facilitate the objectives of the MWCS.

It is envisioned that the shuttle tankers (109) also referred to as the offloading tankers or vessels, will be generally standard in industry. Offloading from the capture vessel will be achieved via bow offloading systems to a dynamically positioned shuttle tanker (109) fitted with a similar bow offloading system.

Embodiments of the Marine Well Containment System and Method

The following paragraphs describe the interaction of the various subsystems and subcomponents of the MWCS and methods of relating to its deployment and use.

In the event of a subsea well blowout or other incident requiring industry response, all components depicted in FIG. 1 would be deployed to the deepwater location of the incident. An advantage of the system is its individual-component nature and the characteristic that it relies on systems and vessels which to a large extent the industry has used. For example, the capture vessel (101) which would be specially adapted for containment system applications, will have some characteristics of floating production systems that industry has long used. This enhances the reliability of the system and its application. Similarly, shuttle tankers (109) have a long history of use in the offshore oil and gas industry.

Once industry becomes aware of an incident requiring response, the general sequence of events that may occur on-site would be as follows; however, the sequence of events disclosed herein represent a nonlimiting outline which is provided for informational purposes. The skilled artisan would readily recognize that the outlined sequence of events represents a high-level description only.

As soon as survey equipment can be deployed (e.g. remotely operated vehicle surface tender vessels), the site of the incident is surveyed to assess the kind of response that is required and to assess the equipment that is required.

To the extent possible, available vessels will begin the necessary preparatory work, such as to clean the area of extraneous material and equipment, to cut pipe, and/or to remove connectors as to facilitate riser installation.

As the above activities are carried out, the modular equipment is installed on the capture vessels, and/or on any other vessels of opportunity.

In particular, the subsea containment assembly (112) and the capture caissons (151), if necessary, are installed on the appropriate vessels.

Other standard modules, such as risers, umbilicals, and the like, are mobilized to the site on vessels of opportunity. Such mobilization is dependent on water depth, the type and size of the riser that is needed, and the anticipated activities that are likely to be carried out at the site.

At the site of the incident, several operations may be carried out simultaneously depending on the nature of the incident and in addition depending on the safety of such operations to all vessels and personnel involved.

If the survey indicates that a caisson (151) is not necessary, then the vessels (101) are used to install the subsea containment system (112) on top of the BOP (111). Simultaneously, other vessels may install the risers (103) and riser foundations, and the manifold (110) and dispersant fluid systems (115).

If a caisson (151) is deployed, then the placement of the caisson takes place first, or after the installation of the cap as explained above. In some situations, the cap is used as a guide mechanism for the caisson installation. The caisson installation is followed by the other operations as noted above.

As will be understood to those skilled in the art, the exact sequence of events and the events that are required will be dependent on the exact situation being faced in the field, and to which operational personnel must adapt. An advantage of embodiments of the present disclosure however is that the MWCS is adaptable to many different offshore scenarios, and can thus be quickly deployed to a wide variety of incidents.

In some embodiments, the MWCS is deployed in shallow water. In this particular embodiment, the only significant design change is that the vertical self-standing riser is not required, in general. In an alternate embodiment, the MWCS that has been deployed in shallow water may be installed with only a flexible pipe portion of a riser in a lazy wave configuration.

While the techniques of the present disclosure may be susceptible to various modifications and alternative forms, the exemplary embodiments discussed above have been shown by way of example. It should again be understood that the disclosure is not intended to be limited to the particular embodiments disclosed herein. Indeed, the present disclosure includes all modifications, equivalents, and alternatives falling within the spirit and scope of the appended claims.

EXAMPLES

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Example 1

A marine well containment system capable of producing fluids from a marine oil and gas well comprising a blowout preventer capable of producing fluids, a subsea containment assembly installed on the blowout preventer; a riser assembly; and, a capture vessel connected to the riser assembly. The riser assembly further comprises a vertical pipe riser and a flexible riser. The riser assembly is connected to the subsea containment assembly through at least one flexible jumper, at least one umbilical or a combination thereof. The capture vessel is capable of receiving fluids produced by the blowout preventer, receiving fluids captured by the subsea containment assembly, receiving fluids piped through the riser assembly to the capture vessel or any combination thereof.

Example 2

The marine well containment system selected from any one of the examples disclosed herein is modified such that the subsea containment assembly has a permanent mechanical connection to the blowout preventer.

Example 3

The marine well containment system selected from any one of the examples disclosed herein is modified such that the permanent mechanical connection prevents fluids produced by the blowout preventer from escaping.

Example 4

The marine well containment system selected from any one of the examples disclosed herein is modified such that the subsea containment assembly further comprises a plurality of adaptors and connectors. For example, FIG. 3 provides a schematic of the subsea containment assembly illustrating an embodiment in which the subsea containment assembly comprises a plurality of adaptors and connectors (143).

Example 5

The marine well containment system selected from any one of the examples disclosed herein is modified such that the plurality of adaptors and connectors are capable of interacting with one or more of the following selected from the group consisting of a wellhead, a blowout preventer stack, a lower marine riser package and a casing string.

Example 6

The marine well containment system selected from any one of the examples disclosed herein is modified such that at least one of the plurality of adaptors and connectors is configured to vent fluids, configured to provide a port through which an inhibitor may be injected, configured to accommodate at least one subsea gauge, configured to control well backpressure, configured to facilitate a well shut-in or any combination thereof.

Example 7

The marine well containment system selected from any one of the examples disclosed herein is modified such that the subsea containment assembly has a three ram design comprising three rams. Furthermore, the marine well containment system of any of the disclosed examples is modified such that each ram further comprises a plurality of connections. Also, the marine well containment system of any of the disclosed examples is modified such that the connections have a flange design. In any of the examples disclosed herein, the connections are configured to connect with at least one adapter.

Example 8

The marine well containment system selected from any one of the examples disclosed herein is modified such that each ram has choke and kill ability.

Example 9

A marine well containment system capable of producing fluids from a marine oil and gas well comprising a capture caisson; a blowout preventer capable of producing fluids; a subsea containment assembly installed on the blowout preventer; a riser assembly; a capture vessel connected to the riser assembly.

In this example, the blowout preventer is enclosed in the capture caisson. Also, this example calls from the subsea containment to be exterior to the capture caisson. The riser assembly further comprises a vertical pipe riser and a flexible riser and the riser assembly is connected to the subsea containment assembly through at least one flexible jumper, at least one umbilical or any combination thereof. Also, the capture vessel is capable of receiving fluids produced by the blowout preventer, receiving fluids captured by the capture caisson, receiving fluids captured by the subsea containment assembly, receiving fluids piped through the riser assembly to the capture vessel or any combination thereof.

Example 10

The marine well containment system selected from any one of the examples disclosed herein is modified such that the capture caisson is capable of forming a seal with the seabed.

Example 11

The marine well containment system selected from any one of the examples disclosed herein is modified such that the capture caisson forms a mechanical connection with the blowout preventer, the subsea containment assembly or both.

Example 12

The marine well containment system selected from any one of the examples disclosed herein is modified such that there is no mechanical connection between the capture caisson and the blowout preventer.

Example 13

A marine well containment system capable of producing fluids from a marine oil and gas well comprising at least one capture caisson, a subsea containment assembly installed on the exterior of at least one capture caisson; a riser assembly, and a capture vessel connected to the riser assembly. The capture vessel is capable of receiving fluids produced by the well, receiving fluids captured by at least one capture caisson, receiving fluids captured by the subsea containment assembly, receiving fluids piped through the riser assembly to the capture vessel or any combination thereof. The riser assembly further comprises a vertical pipe riser and or a flexible riser. The riser assembly is connected to the subsea containment assembly through at least one flexible jumper, at least one umbilical or any combination thereof.

Example 14

The marine well containment system selected from any one of the examples disclosed herein is modified such that at least one capture caisson is capable of forming a seal with the seabed.

Example 15

The marine well containment system selected from any one of the examples disclosed herein is modified such that at least one capture caisson forms a mechanical connection with the subsea containment assembly.

Example 16

The marine well containment system selected from any one of the examples disclosed herein is modified such that a second capture caisson encloses a first capture caisson and the subsea containment assembly is exterior to the second capture caisson.

Example 17

The marine well containment system selected from any one of the examples disclosed herein is modified such that the subsea containment assembly has a permanent mechanical connection to at least one capture caisson, either the first or the second capture caisson.

Example 18

The marine well containment system selected from any one of the examples disclosed herein is modified such that the permanent mechanical connection prevents fluids produced by the well from escaping the capture caisson.

Example 19

The marine well containment system selected from any one of the examples disclosed herein is modified such that the marine well containment system is mechanically connected to a variety of surface components.

Example 20

Also, the marine well containment system selected from any one of the examples disclosed herein is modified such that it is connected to a turret module.

Example 21

In addition to the examples disclosed herein, each of the disclosed examples of the marine well containment system is modified such that the subsea containment assembly is connected to a subsea manifold. The subsea manifold distributes or is used to distribute fluids to at least one capture vessel.

Example 22

The following example describes a method of controlling a well comprising at least the step of assembling components of a marine containment system that includes a subsea containment assembly. The marine containment system is selected from any one of the examples of a marine containments system as disclosed herein.

Example 23

Selected from any one of the examples disclosed herein, the method of controlling a well is modified such that the method further comprises the step of installing the subsea containment assembly on the well to be controlled.

Example 24

Selected from any one of the examples disclosed herein, the method of controlling a well is modified such that the method further comprises the step of installing a capture caisson over the well to be controlled such that the step of installing the capture caisson is performed before the step of installing the subsea containment assembly.

Example 25

Selected from any one of the examples disclosed herein, the method of controlling a well is modified such that the step of installing the capture caisson further comprises the step of enclosing a blowout preventer.

Example 26

Selected from any one of the examples disclosed herein, the method of controlling a well is modified such that the subsea containment assembly installed on the well to be controlled is connected to the capture caisson.

Example 27

Selected from any one of the examples disclosed herein, the method of controlling a well is modified such that the method further comprises the step of forming a seal between the capture caisson and the seabed.

Example 28

Selected from any one of the examples disclosed herein, the method of controlling a well is modified such that the method further comprises the step of forming a mechanical connection between the capture caisson and the blowout preventer, the subsea containment assembly or both.

Example 29

Selected from any one of the examples disclosed herein, the method of controlling a well is modified such that the method further comprises the step of connecting a riser assembly to the subsea containment assembly, and the riser assembly further comprises a vertical pipe riser and a flexible riser.

Example 30

Selected from any one of the examples disclosed herein, the method of controlling a well is modified such that the method further comprises the step of connecting the riser assembly to a capture vessel, and the capture vessel is capable of receiving fluids from the well to be controlled.

Example 31

Selected from any one of the examples disclosed herein, the method of controlling a well is modified such that the method further comprises the step of forming a mechanical connection between the subsea containment assembly and the blowout preventer.

Example 32

Selected from any one of the examples disclosed herein, the method of controlling a well is modified such that the marine well containment system prevents fluids produced by the blowout preventer from escaping.

Example 33

Selected from any one of the examples disclosed herein, the method of controlling a well is modified such that the subsea containment assembly further comprises a plurality of adaptors and connectors.

Example 34

Selected from any one of the examples disclosed herein, the method of controlling a well is modified such that the plurality of adaptors and connectors are capable of interacting with one or more of the following selected from the group consisting of a wellhead, a blowout preventer stack, a lower marine riser package and a casing string.

Example 35

Selected from any one of the examples disclosed herein, the method of controlling a well is modified such that at least one of the plurality of adaptors and connectors is configured to vent fluids, configured to provide a port through which an inhibitor may be injected, configured to accommodate at least one subsea gauge, configured to control well backpressure, configured to facilitate a well shut-in or a combination thereof.

Example 36

Selected from any one of the examples disclosed herein, the method of controlling a well is modified such that the subsea containment assembly has a three ram design comprising three rams and further comprises a plurality of connections wherein the connections have a flange design and wherein the connections are configured to connect with at least one adapter.

Example 37

Selected from any one of the examples disclosed herein, the method of controlling a well is modified such that each ram has choke and kill ability.

Example 38

Selected from any one of the examples as disclosed herein, the method of controlling a well is modified such that the method incorporates at least one disclosed example or at least one disclosed embodiment of a marine well containment system capable of producing fluids from a marine oil and gas well.

Example 39

Selected from any one of the examples as disclosed herein, the method of controlling a well is modified such that the method incorporates at least one partial aspect of a disclosed embodiment or example, incorporates entire aspects of a disclosed embodiment, incorporates aspects of all disclosed embodiments or examples, or incorporates a combination of partial or entire aspects of all disclosed embodiments or examples.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A marine well containment system capable of producing fluids from a marine oil and gas well comprising:

a blowout preventer;

a subsea containment assembly connected on top of the blowout preventer and located in substantially close proximity to the seabed;

a riser assembly, wherein the riser assembly further comprises a vertical pipe riser and a flexible riser and wherein the riser assembly is connected to the subsea containment assembly;

a capture vessel connected to the riser assembly; wherein the capture vessel is capable of receiving fluids produced by the blowout preventer, captured by the subsea containment assembly, piped through the riser assembly to the capture vessel or a combination thereof.

2. The marine well containment system of claim 1, wherein the subsea containment assembly has a mechanical connection to the blowout preventer.

3. The marine well containment system of claim 2, wherein the mechanical connection prevents fluids produced by the blowout preventer from escaping.

4. The marine well containment system of claim 1, wherein the subsea containment assembly further comprises a plurality of adaptors and connectors.

5. The marine well containment system of claim 4, wherein the plurality of adaptors and connectors are capable of interacting with one or more of the following selected from the group consisting of a wellhead, a blowout preventer stack, a lower marine riser package and a casing string.

6. The marine well containment system of claim 4, wherein at least one of the plurality of adaptors and connectors is configured to vent fluids, configured to provide a port through which an inhibitor may be injected, configured to accommodate at least one subsea gauge, configured to control well backpressure, configured to facilitate a well shut-in or a combination thereof.

7. The marine well containment system of claim 1, wherein the subsea containment assembly further comprises three rams.

8. The marine well containment system of claim 7, wherein each ram has choke and kill ability.

9. A marine well containment system capable of producing fluids from a marine oil and gas well comprising:

a capture caisson;

a blowout preventer capable of producing fluids wherein the blowout preventer is enclosed in the capture caisson;

a subsea containment assembly installed on top of the blowout preventer wherein the subsea containment is exterior to the capture caisson and located in substantially close proximity to the seabed;

a self-standing riser assembly, wherein the riser assembly further comprises a seabed foundation, a vertical pipe riser and a flexible riser and wherein the riser assembly is connected to the subsea containment assembly;

a capture vessel connected to the riser assembly; wherein the capture vessel is capable of receiving fluids produced by the blowout preventer, captured by the capture caisson, captured by the subsea containment assembly, piped through the riser assembly to the capture vessel or a combination thereof.

10. The marine well containment system of claim 9, wherein the capture caisson is capable of forming a seal with the seabed.

11. The marine well containment system of claim 9, wherein the capture caisson forms a mechanical connection with the blowout preventer, the subsea containment assembly or both.

12. The marine well containment system of claim 9, wherein there is no mechanical connection between the capture caisson and the blowout preventer.

13. The marine well containment system of claim 9, wherein the subsea containment assembly has a mechanical connection to the blowout preventer.

14. The marine well containment system of claim 13, wherein the mechanical connection prevents fluids produced by the blowout preventer from escaping.

15. The marine well containment system of claim 9, wherein the subsea containment assembly further comprises a plurality of adaptors and connectors.

16. The marine well containment system of claim 15, wherein the plurality of adaptors and connectors are capable of interacting with one or more of the following selected from the group consisting of a wellhead, a blowout preventer stack, a lower marine riser package and a casing string.

17. The marine well containment system of claim 15, wherein at least one of the plurality of adaptors and connectors is configured to vent fluids, configured to provide a port through which an inhibitor may be injected, configured to accommodate at least one subsea gauge, configured to control well backpressure, configured to facilitate a well shut-in or a combination thereof.

18. The marine well containment system of claim 9, wherein the subsea containment assembly has a three ram design comprising three rams.

19. The marine well containment system of claim 18, wherein each ram has choke and kill ability.

20. A method of controlling a well comprising the steps of:

assembling components of a marine containment system wherein the marine containment system includes a subsea containment assembly;

installing a capture caisson over the well to be controlled; and installing the subsea containment assembly on top of a blowout preventer connected to the well to be controlled after the step of installing the capture caisson, wherein the subsea containment assembly is located in substantially close proximity to the seabed.

21. The method of claim 20 wherein the step of installing the capture caisson further comprises the step of enclosing the blowout preventer.

22. The method of claim 21, wherein the subsea containment assembly installed on the well to be controlled is connected to the capture caisson.

23. The method of claim 22 further comprising the step of forming a seal between the capture caisson and the seabed.

24. The method of claim 23 further comprising the step of forming a mechanical connection between the capture caisson and the blowout preventer, the subsea containment assembly or both.

25. The method of claim 22 further comprising the step of forming a mechanical connection between the subsea containment assembly and the blowout preventer.

26. The method of claim 25, wherein the marine well containment system prevents fluids produced by the blowout preventer from escaping.

27. The method of claim 25 wherein the subsea containment assembly further comprises a plurality of adaptors and connectors.

28. The method of claim 27 wherein the plurality of adaptors and connectors are capable of interacting with one or more of the following selected from the group consisting of a wellhead, a blowout preventer stack, a lower marine riser package and a casing string.

29. The method of claim 27 wherein at least one of the plurality of adaptors and connectors is configured to vent fluids, configured to provide a port through which an inhibitor may be injected, configured to accommodate at least one subsea gauge, configured to control well backpressure, configured to facilitate a well shut-in or a combination thereof.

30. The method of claim 29 wherein the subsea containment assembly has a three ram design comprising three rams.

31. The method of claim 30 wherein each ram has choke and kill ability.

32. The method of claim 20, further comprising the step of connecting a riser assembly to the subsea containment assembly, wherein the riser assembly further comprises a vertical pipe riser and a flexible riser.

33. The method of claim 32, further comprising the step of connecting the riser assembly to a capture vessel wherein the capture vessel is capable of receiving fluids from the well to be controlled.

* * * * *